252-99 AU 165 EX
7/6/76 XR 3,968,046

United States Patent [19]

Smeets

[11] 3,968,046

[45] July 6, 1976

[54] POLYPHOSPHATE FREE DETERGENT COMPOSITIONS

[75] Inventor: Fred Smeets, Tienen, Belgium

[73] Assignee: Citrex, Société Anonyme, Brussels, Belgium

[22] Filed: Feb. 28, 1974

[21] Appl. No.: 447,037

[30] Foreign Application Priority Data

Mar. 1, 1973 United Kingdom ..... 9936/73

[52] U.S. Cl. ..... 252/95; 252/99; 252/538; 252/546; 252/552; 252/557; 252/DIG. 1; 260/535 P

[51] Int. Cl.[2] ..... C11D 3/395; C11D 7/54

[58] Field of Search ..... 252/95, 557, 99, 538, 252/552, DIG. 1, DIG. 15; 260/535 P

[56] References Cited

UNITED STATES PATENTS 3,586,715 6/1971 Smeets ..... 260/535 P 3,862,965 1/1975 Werner et al. ..... 252/557

*Primary Examiner*—Thomas J. Herbert, Jr.
*Attorney, Agent, or Firm*—Wenderoth, Lind & Ponack

[57] ABSTRACT

A detergent composition which comprises (a) 1 to 99, preferably 1 to 30, parts by weight of a sodium, potassium, ammonium or triethanolamine salt of an organic polycarboxylic acid selected from the group consisting of (1) an unsaturated tetracarboxylic acid, abbreviated as UPC, obtained by pyrolysing an alkaline earth metal citrate and (2) a sulfonated tetracarboxylic acid, abbreviated as SPC, obtained by saturating the double bond of the UPC acid by means of a sulfonation agent, (b) 99 to 1, preferably 99 to 70, parts by weight of an alkali metal sulfate selected from sodium and potassium sulfates, and optionally at least one component selected from the group consisting of an anionic surfactant, a non-ionic surfactant, a bleaching agent, an alkali metal silicate, a stabilizer, a polyelectrolyte, adjuvants, water and an abrasive.

24 Claims, No Drawings

POLYPHOSPHATE FREE DETERGENT COMPOSITIONS

The present invention is concerned with detergent compositions which do not contain polyphosphates but which, nevertheless, inhibit the precipitation of agents responsible for the hardness of water.

In the context of the present invention, the expression "detergent composition" includes compositions used for preventing the precipitation of calcareous material on the walls of industrial and domestic heating apparatus, i.e. water softening agents, as well as washing compositions, scouring compositions, cosmetic products and the like, which may be in all the usual physical forms, for example, cakes, powders, granulates, gels, pastes, solutions, emulsions, suspensions and the like.

our co-pending patent application Ser. No. 447,039 of even date is concerned with detergent compositions (as defined above) in which the alkali metal polyphosphates generally used in compositions of this kind are replaced by two substances in physical association, namely (a) a sulfopolycarboxylic acid ester salt (defined hereinbelow) and (b) an alkali metal sulfate, preferably sodium sulfate. The combination of (a) and (b) synergistically inhibits the precipitation of calcium and magnesium cations and retains this valuable property when the agents ordinarily present in detergent compositions (anionic and non-ionic surfactants, percompounds, alkali metal silicates, stabilizers, polyelectrolytes, colouring agents, scents, anti-soil redeposition agents, optical whitening agents, anti-corrosive agents, anti-foaming agents, anti-dulling agents, buffer agents, abrasives and the like) are added to it.

The sulfopolycarboxylic acid ester salt (a) is obtained in the following manner:

1. An alkaline earth metal citrate is pyrolyzed at a temperature within the range of 250° to 400°C for a period of time until an increase in titratable alkalinity of the reaction mixture is obtained and until not more than 32% by weight of the original citric acid salt remains in the reaction mixture. The pyrolysis product obtained in this manner is composed mainly of an alkaline earth metal salt of an unknown organic acid which contains a double bond and about four carboxyl groups, and which is designated by the abbreviation "UPC acid".

2. The double bond of the UPC acid is saturated with a sulfonation agent ($SO_3$, $NaHSO_3$ or the like) in order to obtain a sulfopolycarboxylic acid which is referred to by the abbreviation SPC acid.

3. The carboxyl groups of the SPC acid are partially or, preferably, completely esterified with at least one non-ionic compound containing at least one hydroxyl group and the $HSO_3$ group is salified by means of an alkali to give the desired substance (a) above.

Steps (1) and (2) are described in out U.S. Pat. No. 3,586,715 and step (3) is described in our British Patent Specification No. 1,165,788. Both are incorporated here by way of reference.

According to the present invention, we have found that the alkali metal salts of UPC acid, and also of SPC acid, likewise have the property of effectively inhibiting the precipitation of agents responsable for the hardness of water. Furthermore and more particularly, a synergistic effect has also been found when the alkali metal salts of UPC acid and/or of SPC acid are associated with an alkali metal sulfate, preferably sodium sulfate, for the purpose of inhibiting the precipitation of calcium and magnesium ions in hard waters. This discovery is surprising because, as is shown hereinafter in the specific Examples, the polycarboxylic and sulfopolycarboxylic acids at present known are, in the form of their alkali metal salts, much less effective in inhibiting the precipitation of calcium and magnesium cations in water, either when used alone or when in physical association with an alkali metal sulfate. Since, on the one hand, the alkali metal salts of UPC acid and of SPC acid are biodegradable and have a low toxicity and, on the other hand, since alkali metal sulfates are not toxic in the amounts used, these substances can, therefore, be used as substitute products for alkali metal polyphosphates in detergent compositions with a view to eliminating the phenomenon of eutrophication caused by the presence of polyphosphates, i.e. the proliferation of aquatic algae in static and running water.

The detergent composition according to the present invention consequently comprises two essential components (a) and (b):

a. 1 to 99, preferably 1 to 30, parts by weight of alkali metal salts of UPC acid and/or SPC acid, b. 99 to 1, preferably 99 to 70, parts by weight of alkali metal sulfate, preferably sodium and/or potassium sulfate, the sum of amounts of the components (a) and (b) representing always 100 parts by weight.

However, in addition to the essential components (a) and (b) mentioned hereinabove, the detergent composition according to the invention may also contain at least one of the following optional components;

c. anionic surfactant,
d. non-ionic surfactant,
e. bleaching agent,
f. alkali metal silicate,
g. stabilizer,
h. polyelectrolyte,
i. adjuvants (colouring matter, scent, thickener, optical whitening agent, anti-corrosive agent, anti-dulling agent, anti-foaming agent, pH buffer agent (for example borax), disinfectants and the like),
j. water,
k. abrasive.

Full details regarding the preparation of UPC and SPC acids are given in our above-mentioned U.S. Pat. No. 3,586,715. The alkali metal salts (a) of SPC and UPC acid are prepared from the free acids and/or their alkaline earth metal salts in known manner by reacting them with an alkali metal hydroxide, preferably with sodium hydroxide; however, as can be seen in the examples of realization of the present invention, the alkali salt of UPC or SPC acid may also be a potassium, ammonium or triethanolamine salt. In addition to its anti-precipitant effect, component (a) offers the additional advantage of hardening the grains of the detergent composition and of buffering the pH.

The sodium and/or potassium sulfate (b) may be in anhydrous form or in a form containing water of crystallization. Furthermore, it may be chemically pure or of ordinary technical quality. Nevertheless, in calculating the sodium and/or potassium sulfate content of the composition, reference will here always be made to the anhydrous salt.

The anionic surfactant (c) is, for example, a soap of a fatty acid containing 10 to 30 carbon atoms, an alkyl sulfonate containing 8 to 25 carbon atoms, a secondary alkyl sulfate containing 10 to 18 carbon atoms, an alkylbenzene-sulfonate containing 10 to 18 carbon atoms in the alkyl radical, a primary alkyl sulfate containing 8 to 18 carbon atoms, an alkyl-polyoxyethylene-ether sulfate or an alkylaryl-polyoxyethylene-ether sulfate in which the alkyl radical contains 8 to 18 carbon atoms and the polyoxyethylene group contains 1 to 10 ethylene oxide units, or a salt of an ester of a sulfopolycarboxylic acid, for example of sulfosuccinic acid or sulfotricarballylic acid, or of UPC and SPC acids, esterified with alcohols and/or non-ionic surfactant compounds containing at least one hydroxyl group. The anionic surfactant (c) is an optional component in the detergent composition according to the invention; if present, 1 to 25, preferably 5 to 15 parts by weight thereof are used per 100 parts by weight of the sum of (a) and (b).

The non-ionic surfactant (d) is for example, an alkylphenol containing 6 to 15 carbon atoms in the alkyl radical and ethoxylated with 3 to 50 moles of ethylene oxide per mole of alkylphenol; an aliphatic alcohol of natural or synthetic origin which contains 4 to 22 carbon atoms and which is ethoxylated with 3 to 50 moles of ethylene oxide per mole of alcohol; a fatty acid ethanolamide containing 10 to 22 carbon atoms; or a fatty acid ethanolamide containing 10 to 22 carbon atoms and ethoxylated with 0.5 to 20 moles of ethylene oxide. The non-ionic surfactant (d) is not an essential component in the detergent composition according to the invention; if present, 1 to 25, preferably 2 to 10 parts by weight thereof are used per 100 parts by weight of (a) + (b).

The bleaching agent (e) can be, for example, hydrogen peroxide, an alkali metal persulfate, percarbonate, persilicate or the like, preferably sodium perborate, of the quality generally used in washing and cleaning compositions, or other whitening agents containing chlorine, for example an alkali metal trichloroisocyanurate or the like. The bleaching agent (e) is an optional component in the detergent composition according to the invention; if present, 1 to 35, preferably 15 to 25 parts by weight thereof are used per 100 parts by weight of (a) + (b).

The alkali metal silicate (f) can be a sodium or potassium silicate in which the $SiO_2/M_2O$ ratio is from 1 : 4 to 4 : 1, M representing sodium or potassium atom. The use of the alkali metal silicate (f) in the detergent composition according to the invention is optional; if present, 1 to 10, preferably 3 to 6 parts by weight thereof are used per 100 parts by weight of (a) + (b).

The stabilizer (g) is generally an organic sequestering agent such as is normally used in washing and cleaning compositions, for example, an alkali metal salt of ethylenediaminetetraacetic acid (EDTA), of nitrilotriacetic acid (NTA), of diethylenetriaminepentaacetic acid (DTPA), of a hydroxypolycarboxylic acid, such as sodium citrate, or of a polycarboxylic acid, such as sodium diglycolate or the like. The stabilizer (g) may also be a mineral compound, such as magnesium silicate or the like. The stabilizer (g) is not an essential component in the detergent composition according to the invention; if present, 0.1 to 10, preferably 0.2 to 2 parts by weight thereof are used per 100 parts by weight of (a) + (b).

The polyelectrolyte (h) can be, for example, an alkali metal salt of an acid such as polyacrylic acid, a maleic anhydride-ethylene copolymer, a maleic anhydride-methyl vinyl ether copolymer, a polymerized hydroxycarboxylic acid or the like. The polyelectrolyte (h) is an optional component in the detergent composition according to the invention; if present, 0.1 to 5, preferably 0.5 to 3 parts by weight thereof are used per 100 parts by weight of (a) + (b).

The adjuvants (i) can be, for example, a colouring matter, a scent, a thickening agent (such as carboxymethylcellulose, polyvinylpyrrolidone, polyvinyl alcohol or the like), an optical whitening agent (for example of the stilbene series), an anti-corrosion or anti-dulling agent, an anti-foaming agent, a pH buffer agent, a disinfectant or the like. The adjuvants (i) are optionally used in the detergent composition according to the invention; if present, 0.1 to 15, preferably 0.2 to 10 parts by weight thereof are used per 100 parts by weight of (a) + (b).

Water (j) is an optional component of the composition of the present invention. The water content may be zero in the case of an anhydrous powder and will be smaller or larger depending upon whether the composition is in the form of a wet powder, a paste, a gel, a solution, an emulsion, a suspension or the like. The water may consist of free water, representing the humidity of the composition, or of water attached to one or more compounds of the composition as water of crystallization. The amount of water in the composition according to the invention, when present, in 0.1 to 1000, preferably 2 to 950 parts by weight per 100 parts by weight of (a) + (b).

The abrasive (k) is used particularly in the case of scouring compositions according to the present invention. It can be at least one of the following abrasive substances, normally used in compositions of this kind: diatomaceous earth, volcanic ash, pumice stone, quartz, feldspar, marble, bentonite, sand, talc or the like, in particles the grain size of which is lower than 80 microns. When used, the abrasive (k) represents 0.1 to 1000, preferably 5 to 950 parts by weight of the sum of (a) and (b).

To sum up, the detergent compositions according to the present invention contain two obligatory components, i.e. the alkali metal salt of UPC and/or SPC acid (a); and the sodium sulfate and/or potassium sulfate (b). The other components (c) to (k) are used only in accordance with the purpose for which the composition of the present invention is intended, for example, as a water softening agent, as a textile washing agent, as a scouring agent or the like, and in accordance with the physical nature of the composition (solid, paste, liquid or the like).

The amount of composition of the present invention to be used varies widely in accordance with a number of factors. For example, if the composition is used for softening water, the quantity added will vary, depending upon the hardness of the water, and the minimum quantity which will prevent any precipitation of insoluble salts will be used. If the composition is used for washing textiles, the quantity will vary not only depending upon the hardness of the water but also depending upon the technique used for washing, particularly the temperature used for the washing liquid. Thus, by way of indication, in countries where textiles are washed at a relatively low temperature, such as the United States and Japan, the quantity may be from 1 to 2 grams per liter of bath and the same will be true if the composition of the present invention is used in regions where the hardness of the water is low. On the other hand, in countries where textiles are washed at a relatively high temperature (particularly in Europe) and where the water used for washing is relatively hard, the quantity may be as much as 20 grams per liter of bath.

When used at an adequate concentration, component (a) completely inhibits the precipitation of the heavy cations present in water. On the other hand, component (b) has only a slight inhibiting effect. It is surprising that, when a combination of (a) and (b) is used, it is found that the minimum quantity of this combination required to inhibit the precipitation of heavy cations in water is substantially less than the minimum individual quantity of (a) and (b) which would have to be used to obtain the same result. This is, therefore, clearly synergism.

The phenomenon of synergism is all the more unexpected because it is peculiar to the specific association of component (a) with component (b). As will be shown in the following Examples, the alkali metal salts of organic polycarboxylic and sulfopolycarboxylic acids, which have a certain chemical relationship with UPC and SPC acids, have, in fact, a substantially poorer anti-precipitant power, not only when used alone but also when used in combination with an alkali metal sulfate.

In the Examples given below, use is made in the tests of the tap water of the town of Tienen (Belgium) which has a very great hardness, as is shown in the following Table I (hardness being expressed in ppm calcium carbonate per liter):

TABLE I

| Total hardness | | Permanent hardness | | Temporary hardness | |
|---|---|---|---|---|---|
| $(Ca^{2+}+Mg^{2+})$ | $Ca^{2+}$ $Mg^{2+}$ | $(Ca^{2+}+Mg^{2+})$ | $Ca^{2+}$ $Mg^{2+}$ | $(Ca^{2+}+Mg^{2+})$ | $Ca^{2+}$ $Mg^{2+}$ |
| 402.3 | 342.2 60.7 | 122.7 | 72.0 50.7 | 280.2 | 270.2 10.1 |

In order to determine the anti-precipitant power of the compositions tested, the following method is used in the specific Examples:

To a definite quantity of natural water, the $Ca^{2+}$ content of which is known, there is added a definite quantity of the detergent composition which is to be tested, the pH is adjusted to 9 and the resulting mixture is boiled under reflux for 30 minutes, whereupon it is allowed to cool and the percentage of $Ca^{2+}$ remaining in solution after filtration through a Whatman 2V filter is determined. The determination of $Ca^{2+}$ is effected by complexometric titration and/or flame spectrophotometry. The precision of the method is 2–3%.

The following Examples are given for the purpose of illustrating the present invention:

EXAMPLE 1

By means of the analytical method described above, the anti-precipitant power towards calcareous material contained in the water of the town of Tienen is determined, using as anti-precipitant agent the sodium salt of UPC acid and the sodium and potassium salts of SPC acid. The results obtained are shown in the following Table II:

TABLE II

| concentration of salt g/l | % of $Ca^{2+}$ remaining in solution | | |
|---|---|---|---|
| | UPC sodium salt | SPC sodium salt | SPC potassium salt |
| 0 | 13.0 | 13.0 | 13.0 |
| 0.25 | | 29.4 | |
| 0.50 | 54.1 | 51.3 | 54.6 |
| 0.75 | | | 65.9 |

TABLE II-continued

| concentration of salt g/l | % of $Ca^{2+}$ remaining in solution | | |
|---|---|---|---|
| | UPC sodium salt | SPC sodium salt | SPC potassium salt |
| 1.00 | 101.7 | 98.9 | 90.8 |
| 1.25 | | | 94.6 |
| 1.50 | 101.7 | 101.4 | 99.1 |
| 2.00 | 101.7 | 100.2 | 102.0 |

This Table shows that, with a concentration of 1 gram per liter of each of the agents according to the present invention, the precipitation of calcareous material is practically completely prevented.

EXAMPLE 2

This Example shows the phenomenon of synergism exhibited by a combination of alkali metal salts of UPC and SPC acids, respectively, with sodium sulfate and potassium sulfate. The results obtained are shown in the following Tables III to VII:

TABLE III

| SPC sodium salt g/l | % of $Ca^{2+}$ remaining in solution | |
|---|---|---|
| | 2.5 g/l of $Na_2SO_4$ | 5.0 g/l of $Na_2SO_4$ |
| 0 | 24.3 | 39.4 |
| 0.1 | 31.8 | 64.7 |
| 0.2 | 68.8 | 97.7 |
| 0.3 | 94.3 | 98.8 |
| 0.4 | 100.2 | 99.1 |
| 0.5 | 100.0 | 100.3 |

TABLE IV

| UPC sodium salt g/l | % of $Ca^{2+}$ remaining in solution | |
|---|---|---|
| | 2.5 g/l of $Na_2SO_4$ | 5.0 g/l of $Na_2SO_4$ |
| 0 | 24.7 | 39.1 |
| 0.1 | — | 78.4 |
| 0.2 | 44.3 | 99.0 |
| 0.3 | — | 102.1 |
| 0.4 | 92.5 | 102.1 |
| 0.5 | — | 102.4 |
| 0.6 | 100.6 | — |
| 0.8 | 101.3 | — |
| 1.0 | 101.7 | — |

TABLE V

| SPC potassium salt g/l | % of $Ca^{2+}$ remaining in solution | |
|---|---|---|
| | 2.5 g/l of $Na_2SO_4$ | 5.0 g/l of $Na_2SO_4$ |
| 0 | 23.2 | 39.2 |
| 0.1 | 35.0 | 69.1 |
| 0.2 | -94.9 | 99.7 |
| 0.3 | 99.1 | 100.0 |
| 0.4 | 100.5 | 100.1 |
| 0.5 | 100.5 | 100.9 |

TABLE VI

| SPC sodium salt g/l | % of $Ca^{2+}$ remaining in solution | |
|---|---|---|
| | 2.5 g/l of $K_2SO_4$ | 5.0 g/l of $K_2SO_4$ |
| 0 | 19.3 | 22.9 |
| 0.1 | 36.5 | 35.9 |
| 0.2 | 44.5 | 61.7 |

TABLE VI-continued

| SPC sodium salt g/l | % of $Ca^{2+}$ remaining in solution 2.5 g/l of $K_2SO_4$ | 5.0 g/l of $K_2SO_4$ |
|---|---|---|
| 0.3 | 94.9 | 94.9 |
| 0.4 | 98.8 | 99.4 |
| 0.5 | 98.8 | 100.2 |

TABLE VII

| UPC sodium salt g/l | % of $Ca^{2+}$ remaining in solution 2.5 g/l of $K_2SO_4$ | 5.0 g/l of $K_2SO_4$ |
|---|---|---|
| 0 | 22.1 | 29.5 |
| 0.1 | 29.7 | 33.5 |
| 0.2 | 53.7 | 76.5 |
| 0.3 | 60.8 | 83.3 |
| 0.4 | 97.9 | 99.7 |
| 0.5 | 102.0 | 101.1 |
| 0.6 | 101.5 | 102.0 |

These Tables show that although the anti-precipitant power of sodium sulfate and of potassium sulfate, when used alone, is negligible, when used in association with the alkali metal salts of UPC and SPC acids, the alkali metal sulfates considerably reduce the amount of UPC and SPC acid salts which has to be added in order to inhibit practically completely the precipitation of calcareous material. Instead of 1 gram per liter as in Example 1, only 0.2 – 0.4 g/l of UPC or SPC acid salt is required with a concentration of 2.5 g/l of alkali metal sulfate and only 0.2 – 0.3 g/l of UPC or SPC acid salt, with a concentration of 5 g/l of alkali metal sulfate.

Similar results are obtained on using the ammonium or triethanolamine salts of SPC

| SPC ammonium salt g/l | % of $Ca^{2+}$ remaining in solution 5.0 g/l of $Na_2SO_4$ |
|---|---|
| 0 | 39.4 |
| 0.1 | 60.0 |
| 0.2 | 100.9 |
| 0.3 | 100.3 |
| 0.4 | 100.9 |
| 0.5 | 102.1 |

| SPC triethanolamine salt g/l | % of $Ca^{2+}$ remaining in solution 5.0 g/l of $Na_2SO_4$ |
|---|---|
| 0 | 39.1 |
| 0.25 | 44.1 |
| 0.30 | 47.9 |
| 0.35 | 58.5 |
| 0.40 | 67.6 |
| 0.45 | 95.9 |
| 0.50 | 97.9 |
| 0.60 | 100.0 |

EXAMPLE 3

This Example shows that the alkali metal salts of various carboxylic and sulfocarboxylic acids which are not in accordance with the present invention, do not have an anti-precipitant power comparable with that of the alkali metal salts of UPC and SPC acids according to the present invention, either when used alone or when used in combination with an alkali metal sulfate.

| | | |
|---|---|---|
| a. | in the absence of $Na_2SO_4$ Sodium salt of the following acids: | Concentration of salts: 1.5 g/l % $Ca^{2+}$ in solution |
| | SPC | 102.6 |
| | UPC | 101.4 |
| | acetic | 15.4 |
| | maleic | 25.5 |
| | succinic | 24.9 |
| | sulfosuccinic | 67.9 |
| | aconitic | 27.6 |
| | sulfotricarballylic | 63.4 |
| | citric | 84.8 |
| b. | in the presence of 2.5 g/l of $Na_2SO_4$ Sodium salt of the following acids: | Concentration of salts: 0.5 g/l % $Ca^{2+}$ in solution |
| | SPC | 100.0 |
| | UPC | 101.2 |
| | acetic | 33.5 |
| | maleic | 36.2 |
| | succinic | 30.3 |
| | sulfosuccinic | 30.6 |
| | aconitic | 28.2 |
| | sulfotricarballylic | 47.6 |
| | citric | 49.2 |

It will be noted, inter alia, that for certain acids not according to the present invention, such as sulfosuccinic acid, sulfotricarballylic acid and citric acid, the presence of alkali metal sulfate in the solution not only does not prevent completely the precipitation of calcareous salts, in contrast to what is found with components (a) according to the present invention, but even exerts a contrary effect on the anti-precipitant power of these acids.

EXAMPLE 4

This Example shows that it is possible to use an alkali metal salt of SPC acid according to the present invention (in the presence or absence of an alkali metal sulfate) together with the anti-precipitant agent described in our above-mentioned copending patent application Ser. No. 447,039 of even date. This agent, which in the present Example is used at a concentration of 0.25 g/liter, is the alkali metal salt of the esterification product of one mole of SPC acid with two moles of Dobanol 91-6 EO (mixture of $C_9$–$C_{11}$ alcohols ethoxylated with 6 moles of ethylene oxide) and two moles of Linevol 79-6 EO (mixture of $C_7$–$C_9$ alcohols ethoxylated with 6 moles of ethylene oxide).

TABLE VIII

| Active matter = SPC acid ester salt of copending Patent Application (0.25 g/l) SPC sodium salt g/l | % of $Ca^{2+}$ remaining in solution 0 g/l of $Na_2SO_4$ | 2.5 g/l of $Na_2SO_4$ |
|---|---|---|
| 0 | 33.0 | 63.6 |
| 0.05 | — | 65.1 |
| 0.10 | — | 95.6 |
| 0.20 | — | 100.0 |
| 0.25 | 43.3 | |
| 0.50 | 43.9 | |
| 1.00 | 78.7 | |
| 1.25 | 98.1 | |
| 1.50 | 100.0 | |

Thus, it can be seen from Table VIII that, in the presence of 2.5 g/l of sodium sulfate, the precipitation of $Ca^{2+}$ is completely prevented by the use of 0.25 g/l of the SPC acid ester salt of the aforesaid copending patent application together with only 0.20 g/l of the SPC sodium salt according to the invention.

EXAMPLE 5

0.5 g. sodium dodecylbenzene sulfonate is added to 1 liter tap water of the town of Tienen (total hardness about 400 ppm, calculated as $CaCO_3$) and variable quantities of the sodium salt of SPC acid and sodium sulfate are added to this solution; the percentage of calcium cation remaining dissolved is then determined by the analytical method described above. The results obtained in this manner are shown in the following Table:

TABLE IX

| Active matter = sodium dodecylbenzenesulfonate (0.5 g/l) SPC sodium salt g/l | % of $Ca^{2+}$ remaining in solution 0 g/l of $Na_2SO_4$ | 2.5 g/l of $Na_2SO_4$ | 5.0 g/l of $Na_2SO_4$ |
|---|---|---|---|
| 0 | 22.3 | 50.4 | 65.9 |
| 0.20 | | | 72.7 |
| 0.25 | | 67.3 | |
| 0.50 | 33.9 | 70.0 | 87.5 |
| 0.75 | | | 100.0 |
| 1.00 | 57.7 | 80.0 | 100.0 |
| 1.25 | | 99.4 | |
| 1.50 | 72.3 | 100.0 | |
| 1.75 | 81.5 | | |
| 2.00 | 99.4 | | |

This Table shows that the anti-precipitant effect of sodium dodecylbenzene sulfonate is insufficient, even in the presence of 5 g/liter of sodium sulfate but when, in addition, the sodium salt of SPC acid is added to the solution, the anti-precipitant effect is improved with an increasing quantity of this salt. However, in the absence of sodium sulfate, 2 g/liter of SPC salt are required; in the presence of 2.5 g/liter of sodium sulfate, 1.25 g/liter of SPC salt have to be used and in the presence of 5 g/liter of sodium sulfate, 0.75 g/liter of SPC salt are sufficient to prevent completely the precipitation of the heavy cations of the water.

EXAMPLE 6

This test is carried out under the same conditions as in Example 5, except that sodium dodecylbenzene sulfonate is replaced by non-ionic surfactants, namely, Tergitol 15S9 (mixture of $C_{11}$–$C_{15}$ unbranched alcohols ethoxylated with 9 moles of ethylene oxide) and Dobanol 45-11 EO (mixture of $C_{14}$–$C_{15}$ synthetic fatty alcohols ethoxylated with 11 moles of ethylene oxide), respectively. The results are shown in the two following Tables X and XI:

TABLE X

| Tergitol 15S9 non-ionic surfactant (0.5 g/liter) SPC sodium salt g/l | % of $Ca^{2+}$ remaining in solution O g/l of $Na_2SO_4$ | 2.5 g/l of $Na_2SO_4$ | 5.0 g/l of $Na_2SO_4$ |
|---|---|---|---|
| 0 | 25.1 | 34.2 | 48.3 |
| 0.10 | | 55.1 | 75.3 |
| 0.20 | | 89.3 | |
| 0.25 | | | 99.4 |
| 0.30 | | 99.4 | |
| 0.40 | | 100.9 | |
| 0.50 | 54.2 | 100.6 | 99.7 |
| 1.00 | 94.9 | | |
| 1.25 | 100.2 | | |
| 1.50 | 102.6 | | |

TABLE X-continued

| Tergitol 15S9 non-ionic surfactant (0.5 g/liter) SPC sodium salt g/l | % of $Ca^{2+}$ remaining in solution O g/l of $Na_2SO_4$ | 2.5 g/l of $Na_2SO_4$ | 5.0 g/l of $Na_2SO_4$ |
|---|---|---|---|
| 2.00 | 99.7 | | |

TABLE XI

| Dobanol 45-11 EO non-ionic surfactant (0.5 g/liter) SPC sodium salt g/l | % of $Ca^{2+}$ remaining in solution 0 g/l of $Na_2SO_4$ | 2.5 g/l of $Na_2SO_4$ |
|---|---|---|
| 0 | 7.4 | 17.8 |
| 0.20 | | 93.7 |
| 0.40 | | 99.8 |
| 0.50 | 47.7 | 100.0 |
| 1.00 | 93.7 | 100.0 |
| 1.25 | 100.0 | |
| 2.00 | 100.3 | |

It can be seen that the anti-precipitant effect of these two non-ionic surfactants is insufficient, even in the presence of sodium sulfate but the addition of the SPC sodium salt considerably improves the anti-precipitant behaviour; that the non-ionic agents of Example 6 have a better behaviour than the anionic agents of Example 5, because it is necessary to add less alkali metal salt of SPC acid and sodium sulfate to obtain complete inhibition of precipitation; and that the anti-precipitant effect of the system (sodium salt of SPC acid + sodium sulfate) according to the present invention is practically not influenced by the presence of non-ionic agents (cf. Example 6 and Example 1).

EXAMPLE 7

This Example shows the advantage of adding the sodium salt of SPC acid in complete detergent powders in order to prevent the precipitation of alkaline earth metal salts when these powders are used in hard water.

The water used for the tests contains 400 ppm expressed in $CaCO_3$/liter and a quantity of 5 grams of each detergent powder is added per liter of bath.

Each powder composition contains:

20% sodium perborate
2% magnesium silicate
5% sodium silicate
2% adjuvants (optical whitening agent, carboxymethyl-cellulose, stabilizer)

the percentage of active material is indicated in the following Table XII, the remaining percentage being sodium sulfate.

In Table XII, the first column indicates the percentage and nature of the active material used, the second column the percentage of the sodium salt of SPC acid added and the third column the percentage of $Ca^{2+}$ of the hard water which remains in solution.

TABLE XII

| Active material | % of sodium salt of SPC acid | % of $Ca^{2+}$ in solution |
|---|---|---|
| 8% Tergitol 15 S 9*: | 0 | 18.7 |
| | 4 | 94.3 |
| | 8 | 96.1 |
| | 12 | 97.0 |
| 8% LAS** + 3% FAS*** + 3% tallow fatty acid soap: | 0 | 47.4 |
| | 4 | 91.7 |
| | 8 | 95.0 |
| | 12 | 96.1 |
| 6% CITREX**** + 6% Tergitol 15 S 9: | 0 | 79.0 |

TABLE XII-continued

| Active material | % of sodium salt of SPC acid | % of $Ca^{2+}$ in solution |
|---|---|---|
| | 4 | 94.7 |
| | 8 | 97.9 |
| | 12 | 98.1 |

*Mixture of $C_{11}$–$C_{15}$ alcohols ethoxylated with 9 moles of ethylene oxide
**Sodium salt of dodecylbenzene sulfonic acid
***Sodium salt of a mixture of sulfated natural $C_{16}$–$C_{18}$ alcohols
****Esterification product of SPC acid and a 50/50 molar mixture of Dobanol 91–6 EO ($C_9$–$C_{11}$ alcohols ethoxylated with 6 moles of ethylene oxide) and Linevol 79–6 EO ($C_7$–$C_9$ alcohols ethoxylated with 6 moles of ethylene oxide).

EXAMPLE 8

This Example gives, in the form of a Table, six formulations of detergent powders which contain the indicated percentages of the sodium salt of SPC acid and of active materials, the other conditions being exactly the same as in Example 7.

TABLE XIII

| Powder No. | Active material | % of sodium salt of SPC | % of $Ca^{2+}$ in solution |
|---|---|---|---|
| 1 | 6% Tergitol 15 S 9<br>4% LAS<br>3% of tallow fatty acid soap: | 8 | 95.2 |
| 2 | 8% LAS<br>3% FAS<br>3% tallow fatty acid soap: | 8 | 95.0 |
| 3 | 8% Tergitol 15 S 9: | 8 | 96.1 |
| 4 | 6% Tergitol 15 S 9<br>4% FAS<br>3% tallow fatty acid soap: | 8 | 95.6 |
| 5 | 6% CITREX<br>6% Tergitol 15 S 9: | 5 | 97.9 |
| 6 | 6% LAS<br>3% FAS<br>4% Tergitol 15 S 9<br>3% tallow fatty acid soap: | 7 | 96.4 |

EXAMPLE 9

By the method well known in the washing powder industry, the ash content is determined after 10 successive washings in a Launder-O-meter.

The experimental conditions are as follows:

Machine :
Launder-O-meter
Control band :
fabric according to ISO standard No. 2267
Temperature of bath :
85°C.
Washing time :
15 minutes
Bath ratio :
1/15
Concentration of washing powder :
8 g/liter of bath
Water used for washing :
water of the town of Tienen diluted to 300 ppm, expressed as $CaCO_3$/liter.

The ash content is determined by incineration. For the tests, use is made of detergent compositions No.5 and No.2 mentioned in Example 8 above, in which the content of the sodium salt of SPC acid is varied. The following Table XIV shows the results obtained:

TABLE XIV

| Powder | % of sodium salt of SPC | Ash content % | pH of bath |
|---|---|---|---|
| Composition No.5 | 0 | 2.81 | 9.58 |
| " | 2.5 | 1.33 | 9.60 |
| " | 5.0 | 0.47 | 9.62 |
| " | 7.5 | 0.36 | 9.68 |
| Composition No.2 | 0 | 2.84 | 9.60 |
| " | 4 | 1.00 | 9.61 |
| " | 8 | 0.56 | 9.60 |
| " | 12 | 0.37 | 9.63 |

It is seen that the ash content (the ash being for the most part composed of the alkaline earth metal salts of the bath water) decreases considerably when the content of the sodium salt of SPC acid in the washing powder is increased.

EXAMPLE 10

Soiled linen is washed 10 times in succession in a washing machine, a control band of fabric according to standard ISO No. 2267 being placed in the bath. The ash content, the soil redeposition rate and the yellowing rate of the control band are thereupon measured. The washing conditions are as follows:

Washing machine :
MIELE 416
Tienen town water, hardness 400 ppm expressed as $CaCO_3$/liter
Linen load :
4 kg (dry)
Soaking :
amount of washing powder 125 g.
20 liters water
maximum temperature 30°C.
time : 10 minutes
Washing :
amount of washing powder 125 g.
15 liters water maximum temperature 85°C.
time : 75 minutes The powders according to the present invention used for the tests were those mentioned in Example 8 under numbers 5, 2 and 6, and they are compared with two commercially available washing powders A and B containing sodium tripolyphosphate. The results obtained are shown in the following Table XV:

TABLE XV

| Washing powders | Powder No. | Ash content | Soil redeposition rate | Yellowing rate |
|---|---|---|---|---|
| Based on the sodium salt of SPC | 5 | 0.08 | 8.8 | 1.6 |
| | | 0.22 | 9.4 | 1.9 |
| | 2 | 0.17 | 9.6 | 2.1 |
| | 6 | 0.22 | 7.4 | 2.0 |
| Commercial powders | A | 1.99 | 9.9 | 1.3 |
| | B | 3.41 | 13.0 | 3.5 |

It can be seen that, despite the absence of tripolyphosphate in the compositions of the present invention, they give results which are at least equal to if not better than those obtained with commercially available powders in practical washing tests.

EXAMPLE 11

The following two formulations according to the invention can be used as water softening agents (in % by weight)

| | | |
|---|---|---|
| sodium salt of SPC acid | 5 | 20 |
| anhydrous sodium sulfate | 95 | 80 |

The dose to be used varies from 1 to 10 g/liter depending on the hardness of water.

EXAMPLE 12

The following formulation can be used as a scouring powder (in % by weight)

| | |
|---|---|
| Na alkylbenzenesulfonate | 2.5 |
| Na salt of SPC acid | 2 |
| Anhydrous sodium sulfate | 20 |
| Borax | 5 |
| Sodium hypochlorite | 0.5 |
| Abrasive (diatomaceous earth) | 70 |

I claim:

1. A phosphate-free detergent composition which comprises a. 1 to 30 parts by weight of a sodium, potassium, ammonium or triethanolamine salt of an organic polycarboxylic acid selected from the group consisting of 1. the unsaturated tetracarboxylic acid which is the pyrolysis product prepared by heating an alkaline-earth metal salt of citric acid to a temperature within the range of 250° to 400°C for a period of time until an increase in titratable alkalinity of the reaction mixture is obtained and until not more than 32% by weight of the original citric acid salt remains in the reaction mixture, and
2. the sulfotetracarboxylic acid obtained by sulfonating the said unsaturated tetracarboxylic acid, and b. 99 to 70 parts by weight of an alkali metal sulfate selected from the group consisting of sodium sulfate and potassium sulfate.

2. The detergent composition according to claim 1, which contains, in addition to components (a) and (b), at least one component selected from the group consisting of an anionic surfactant, a non-ionic surfactant, a bleaching agent, an alkali metal silicate, a stabilizer, a polyelectrolyte, adjuvants, water and abrasive.

3. The detergent composition according to claim 1, which additionally contains, per 100 parts by weight of the sum of (a) and (b), 1 to 25 parts by weight of an anionic surfactant selected from the group consisting of alkali metal salts of fatty acids containing 10 to 30 carbon atoms, alkyl sulfonates containing 8 to 25 carbon atoms, secondary alkylsulfates containing 10 to 18 carbon atoms, alkylbenzene- sulfonates containing 10 to 18 carbon atoms in the alkyl radical, primary alkylsulfates containing 8 to 18 carbon atoms, alkyl-polyoxyethylene-ether sulfates and alkylaryl-polyoxyethylene-ether-sulfates containing 8 to 18 carbon atoms in the alkyl radical and 1 to 10 ethylene oxide units in the polyoxyethylene groups, and salts of esters of a polycarboxylic acid selected from the group consisting of sulfosuccinic acid, sulfotricarballylic acid, said unsaturated tetracarboxylic acid (1) and said sulfotetracarboxylic acid (2), esterified with alcohols and/or non-ionic surfactant compounds having at least one hydroxyl group.

4. The detergent composition according to claim 3, which contains, per 100 parts by weight of the sum of (a) and (b), 5 to 15 parts by weight of the anionic surfactant.

5. The detergent composition according to claim 1, which additionally contains, per 100 parts by weight of the sum of (a) and (b), 1 to 25 parts by weight of a non-ionic surfactant selected from the group consisting of alkylphenols containing 6 to 15 carbon atoms in the alkyl radical and ethoxylated with 3 to 50 moles of ethylene oxide per mole of alkylphenol, aliphatic alcohols containing 4 to 22 carbon atoms, ethoxylated with 3 to 50 moles of ethylene oxide per mole of alcohol, fatty acid ethanolamides containing 10 to 22 carbon atoms and fatty acid ethanolamides containing 10 to 22 carbon atoms ethoxylated with 0.5 to 20 moles of ethylene oxide per mole of ethanolamide.

6. The detergent composition according to claim 5, which contains, per 100 parts by weight of the sum of (a) and (b), 2 to 10 parts by weight of the non-ionic surfactant.

7. The detergent composition according to claim 1, which additionally contains, per 100 parts by weight of the total of (a) and (b), 1 to 35 parts by weight of a bleaching agent selected from the group consisting of hydrogen peroxide, an alkali metal persulfate, an alkali metal percarbonate, an alkali metal persilicate, an alkali metal perborate and a bleaching agent containing chlorine.

8. The detergent composition according to claim 7, which contains, per 100 parts by weight of the total of (a) and (b), 15 to 25 parts by weight of the bleaching agent.

9. The detergent composition according to claim 1, which additionally contains, per 100 parts by weight of the total of (a) and (b), 1 to 10 parts by weight of an alkali metal silicate wherein the $SiO_2/M_2O$ ratio is from 1:4 to 4:1, M being a member selected from the group consisting of sodium and potassium.

10. The detergent composition according to claim 9, which contains, per 100 parts by weight of the total of (a) and (b), 3 to 6 parts by weight of the alkali metal silicate.

11. The detergent composition according to claim 1, which additionally contains, per 100 parts by weight of the total of (a) and (b), 0.1 to 10 parts by weight of a stabilizer selected from the group consisting of alkali metal salts of ethylenediaminetetraacetic acid, alkali metal salts of nitrilotriacetic acid, alkali metal salts of diethylenetriaminepentaacetic acid, alkali metal salts of hydroxypolycarboxylic acids, alkali metal salts of polycarboxylic acids and magnesium silicate.

12. The detergent composition according to claim 11, which contains, per 100 parts by weight of the total of (a) and (b), 0.2 to 2 parts by weight of the stabilizer.

13. The detergent composition according to claim 1, which additionally contains per 100 parts by weight of the total of (a) and (b), 0.1 to 5 parts by weight of a polyelectrolyte which is an alkali metal salt of polyacrylic acid, a maleic anhydride-ethylene copolymer, a maleic anhydride-methyl vinyl ether copolymer and/or alkali metal salt of a polymerized hydrocarboxylic acid.

14. The detergent composition according to claim 13, which additionally contains, per 100 parts by weight of the total of (a) and (b), 0.5 to 3 parts by weight of the polyelectrolyte.

15. The detergent composition according to claim 1, which additionally contains, per 100 parts by weight of the total of (a) and (b), 0.1 to 15 parts by weight of at least one adjuvant selected from the group consisting of colouring matter, scent, a thickening agent, an optical whitening agent, an anticorrosion agent, an anti-foaming agent, a pH buffer agent, a disinfectant and an anti-dulling agent.

16. The detergent composition according to claim 15, which contains, per 100 parts by weight of the total of (a) and (b), 0.2 to 10 parts by weight of the adjuvants.

17. The detergent composition according to claim 1, which additionally contains, per 100 parts by weight of the total of (a) and (b), 0.1 to 1000 parts by weight of water.

18. The detergent composition according to claim 1, which additionally contains, per 100 parts by weight of the total of (a) and (b), 2 to 950 parts by weight of water.

19. The detergent composition according to claim 1, which additionally contains, per 100 parts by weight of the total of (a) and (b), 0.1 to 1000 parts by weight of an abrasive selected from the group consisting of diatomaceous earth, volcanic ash, pumice stone, quartz, feldspar, marble, bentonite, sand and talc, in particles the grain size of which is lower than 80 microns.

20. The detergent composition according to claim 19, which contains, per 100 parts by weight of the total of (a) and (b), 5 to 950 parts by weight of the abrasive.

21. The detergent composition according to claim 1 in the form of a cake, a powder, a granulate, a gel, a paste, a solution, an emulsion or a suspension.

22. A water softening agent constituted by the detergent composition according to claim 1.

23. A scouring agent constituted by the composition according to claim 2.

24. A textile washing agent constituted by the composition according to claim 2.

* * * * *